US011845273B2

(12) United States Patent
Ishii et al.

(10) Patent No.: US 11,845,273 B2
(45) Date of Patent: Dec. 19, 2023

(54) INKJET PRINTER

(71) Applicant: Hitachi, Ltd, Tokyo (JP)

(72) Inventors: Eiji Ishii, Tokyo (JP); Koma Sato, Tokyo (JP); Shoichiro Kisanuki, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 17/764,254

(22) PCT Filed: Aug. 31, 2020

(86) PCT No.: PCT/JP2020/032847
§ 371 (c)(1),
(2) Date: Mar. 28, 2022

(87) PCT Pub. No.: WO2021/070513
PCT Pub. Date: Apr. 15, 2021

(65) Prior Publication Data

US 2022/0363054 A1 Nov. 17, 2022

(30) Foreign Application Priority Data

Oct. 10, 2019 (JP) ..... 2019-186693

(51) Int. Cl.
*B41J 2/09* (2006.01)
*B41J 2/045* (2006.01)
*B41J 2/085* (2006.01)

(52) U.S. Cl.
CPC ..... *B41J 2/09* (2013.01); *B41J 2/04576* (2013.01); *B41J 2/085* (2013.01)

(58) Field of Classification Search
CPC ..... B41J 2/12; B41J 2/075; B41J 2/125; B41J 2002/022; B41J 2002/033; B41J 2/02;
(Continued)

(56) References Cited

U.S. PATENT DOCUMENTS 4,723,129 A 2/1988 Endo et al.
2007/0257971 A1 11/2007 Jeanmaire

FOREIGN PATENT DOCUMENTS

JP 7-25007 A 1/1995
JP 2019-59199 A 4/2019
JP 2019-199058 A 11/2019

OTHER PUBLICATIONS

International Search Report (PCT/ISA/210) issued in PCT Application No. PCT/JP2020/032847 dated Nov. 24, 2020 with English translation (four (4) pages).

(Continued)

*Primary Examiner* — Kristal Feggins
(74) *Attorney, Agent, or Firm* — Crowell & Moring LLP

(57) ABSTRACT

The purpose of the present invention is to prevent the flow of air flowing from the outside of a cover part into the cover part via an ink droplet passing hole as air accompanying printing droplets outflows. An inkjet recording device is provided with: a recording mechanism (printing mechanism) having an ink room 101 that ejects an ink column 107, charging electrodes 103A and 103B that charge ink droplets 106 generated from the ink column 107, and deflection electrodes 105A and 105B that deflect charged ink droplets 106A; and a cover part 118 that has an ink droplet passing hole 117 through which the ink droplets 106A deflected by the deflection electrodes 105A and 105B pass and covers the recording mechanism. The inkjet recording device causes the ink droplets 106A to land onto a recording object 116 that moves relative to a recording head 100 to perform recording. A vent hole 130 is provided in a lateral surface of the cover part 118.

9 Claims, 4 Drawing Sheets

(58) Field of Classification Search
CPC ... B41J 2/07; B41J 2/09; B41J 2/04576; B41J 2/085; B41J 2/08
See application file for complete search history.

(56) References Cited

OTHER PUBLICATIONS

Japanese-language Written Opinion (PCT/ISA/237) issued in PCT Application No. PCT/JP2020/032847 dated Nov. 24, 2020 (four (4) pages).

INKJET PRINTER

TECHNICAL FIELD

The present invention relates to an inkjet printer.

BACKGROUND ART

As a background art of the present technical field, an inkjet printer described in Japanese Unexamined Patent Application Publication No. 2019-59199 (Patent Literature 1) is known.

Patent Literature 1 describes an inkjet printer aiming at reducing the amount of ink particles that flows into the interior of the print head (recording head). This inkjet printer includes a nozzle that executes separation into ink particles, a charge electrode that electrically charges the ink particles, a deflection electrode that deflects the electrically charged ink particles, and a printing head cover having an ink particle passing hole that ejects the deflected ink particles onto a printing object. The printing head cover includes a passage reduction part to reduce a passage formed between the tip of the printing head cover and the printing object. The passage reduction part has a protruding shape in which an area of a cross section nearer to the ink particle passing hole is larger than an area of a cross section farther from the ink particle passing hole (summary).

In Patent Literature 1, a flow velocity distribution similar to Couette flow is formed in the region configured between the tip of the printing head cover and the surface of the printing object. The airflow generated in response to this flow velocity distribution impinges the side surface on the upstream side of the printing head cover and stagnates to generate a high pressure region. Patent Literature 1 focuses on this high pressure region. That is, this high pressure region spreads to near the ink particle passing hole of the printing head cover. Additionally, the interior of the print head is substantially at atmospheric pressure and lower in pressure than the high pressure region. The airflow is thus generated from the high pressure region outside the printing head cover to the interior of the print head. The ink mist group generated due to the collision of a next electrically charged particle group before the electrically charged particle group that has landed on the printing object dries is entrained in the airflow toward the interior of the print head and is likely to enter the interior of the print head (Paragraph 0018).

CITATION LIST

Patent Literature

[Patent Literature 1] Japanese Unexamined Patent Application Publication No. 2019-59199

SUMMARY OF INVENTION

Technical Problem

Patent Literature 1 considers the ink mist (splashing droplets) that enters the interior of the recording head when the region configured between the tip of the printing head cover (record head cover: hereinafter called a cover portion) and the surface of the printing object (printing body) is highly pressured. However, there is no consideration about the air entrained by the ink particles (printing droplets) flowing to outside the cover portion through the ink particle passing hole (ink droplet passing hole). That is, the flow of air (airflow) is generated from outside to inside the cover portion to compensate for the air entrained by the printing droplets. This airflow may entrain the splashing droplets in the recording head.

An object of the present invention is to inhibit the airflow flowing from outside to inside the cover portion through the ink droplet passing hole with the outflow of the air entrained by the printing droplets to prevent the dirt due to the splashing droplets at the printing mechanism inside the cover portion.

Solution to Problem

To achieve the above object, an inkjet printer of the present invention includes a recording head including: a recording mechanism having an ink chamber that ejects an ink column, a charge electrode that electrically charges ink droplets generated from the ink column, and a deflection electrode that deflects the electrically charged ink droplets; and a cover portion that has an ink droplet passing hole through which the ink droplets deflected by the deflection electrode pass and covers the recording mechanism. In an inkjet printer that makes ink droplets land onto a recording object that moves relative to the recording head to execute recording, a vent is provided to the side surface of the cover portion.

Advantageous Effects of Invention

According to the present invention, in the inkjet printer, the airflow flowing from outside the cover portion to inside the cover portion through the ink droplet passing hole with the outflow of the air entrained by the ink droplets is controllable. Additionally, the splashing droplets generated at landing of ink droplets entraining this inlet air can be inhibited from entering the interior of the cover portion to inhibit the dirt of the recording mechanism inside the cover portion. Printing quality can be thus improved.

The problems, configurations, and advantageous effects other than the above description will be apparent from explanation of the following embodiments.

DESCRIPTION OF EMBODIMENTS

Figure 1:
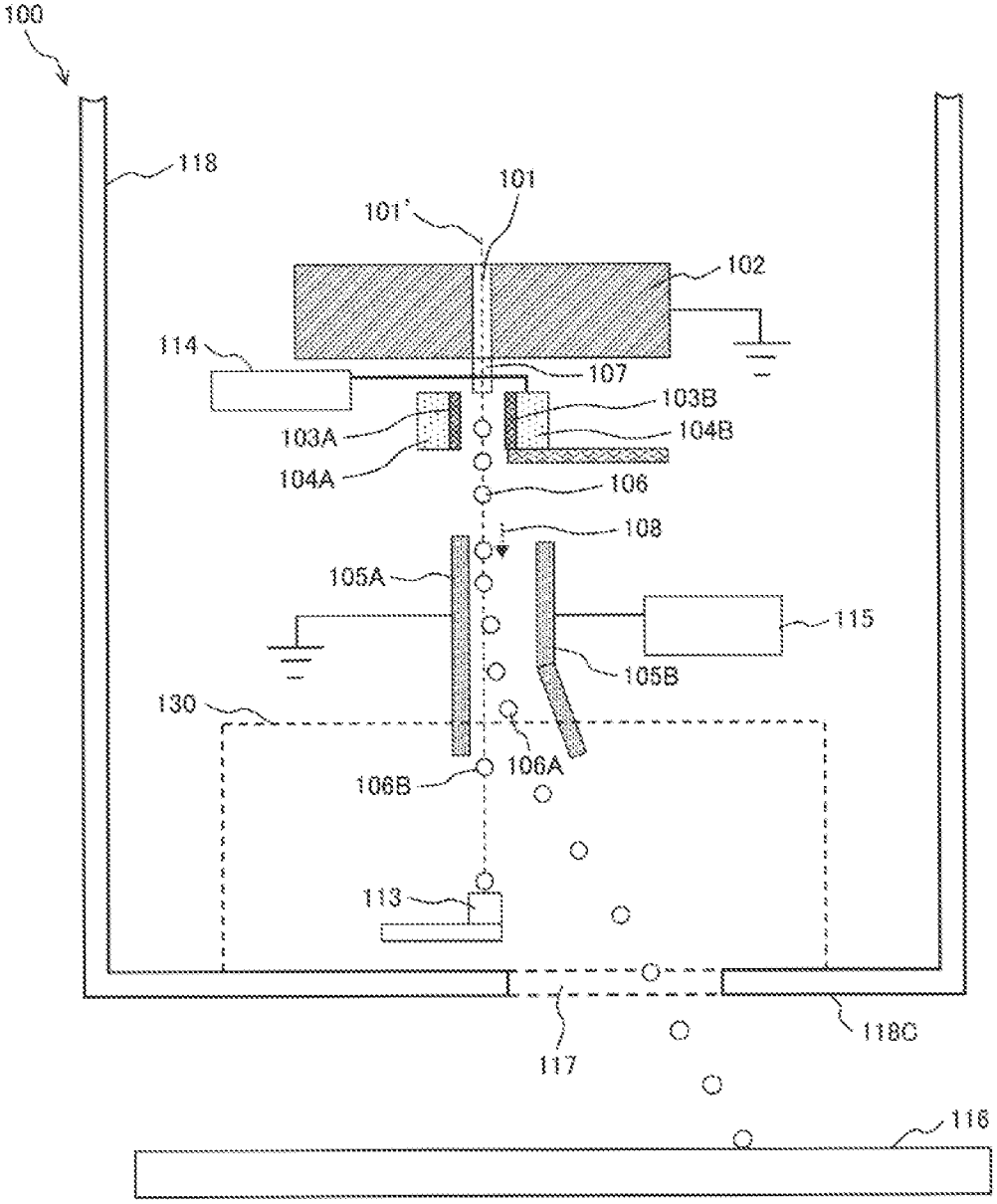
FIG. 1 illustrates a main configuration of a continuous inkjet printer of the first embodiment of the present invention.

A continuous inkjet printer (CIJP) among inkjet printers is a stable droplet ejection device is more reliable and maintainable than an on-demand inkjet device used in printers for home use or offices. For this reason, the continuous inkjet printer is also applicable to manufacturing equipment for, e.g., electronic devices requiring functional ink application and patterning using liquid. This equipment requires high reliability, high maintainability, and high stability. Moreover, the present device can be used also for three-dimensional modeling, for example, as a 3D printer.

The continuous inkjet printer pressurizes liquid (ink) stored in an ink tank by use of, e.g., a pump and continuously ejects the ink through a fine nozzle. The ejected liquid (ink column) is vibrated by, e.g., a Piezoelectric element and thus shaken to cut the ink column for flight of the generated micro ink droplets. At this time, a charge electrode is located near a liquid droplet forming position where the ink columns is cut. Then, an electrical field is applied to the micro ink droplets to electrically charge the formed droplets.

The flight direction of the electrically charged droplets are controlled by the presence or absence of charge or the magnitude of charge (charge amount) in the electrical field generated by applying voltage to the deflected electrode located downstream of the charge electrode (deflection process).

This deflection process is broadly categorized into two types, a multi deflection type and a binary deflection type. In either type, the charge amount for the ejected liquid (ink) is controlled to deflect the liquid. It is thus unnecessary to control ejection of each droplet, and the configuration of the device becomes simple. Moreover, droplet ejection is performed continuously. it is thus unlikely to generate blockage of the nozzle, and high reliability is securable.

In the continuous inkjet printer, a cover portion is provided to cover the printing mechanism of the recording head, and droplets for printing passes through the ink droplet passing hole (hereinafter called a slit) formed to the cover portion in a slit shape and land onto a printing body. When the droplets for printing (printing droplets) land onto the printing body, part of the droplets and the droplets that have been previously landed but not yet dried are suspended around as micro splashing droplets in response to the impact. Part of the flying droplets enters the interior of the cover portion from the slit to dirty the printing mechanism inside the cover portion. This results in a problem.

Therefore, it is necessary to prevent the splashing droplets from entering the interior of the cover portion from the slit provided to the cover portion.

Embodiments of a continuous inkjet printer of the present invention are described below with reference to the drawings. In each drawing, the same reference signs are used for the same elements, and the redundant explanation is omitted. It is noted that the present invention is not limited to each embodiment described below and includes various modifications. For example, the embodiments described below are described in detail for understandable explanation of the present invention, which is not necessarily limited to one having all the configurations. Part of a configuration of a certain embodiment is replaceable with a configuration of another embodiment. Moreover, it is also possible to add a configuration of another embodiment to a configuration of a certain embodiment. Moreover, it is possible to carry out addition, deletion, or substitution in part of a configuration of each embodiment by use of another configuration.

Moreover, the term including "printing" such as "printing body" and "printing pattern" is used in the following explanation, but targets to be printed are not limited to characters and includes pictures and lines.

Embodiment 1

A configuration of a continuous inkjet printer of the first embodiment is explained using FIG. 1. FIG. 1 illustrates a main configuration of the continuous inkjet printer of the first embodiment of the present invention. In addition, a printing body (printing object) 116 is conveyed in the direction perpendicular to the paper of FIG. 1.

In FIG. 1, a recording head (an inkjet head, a print head, or a printing device) 100 of the continuous inkjet printer of the present embodiment includes: a nozzle head 102 equipped with an ink chamber 101 that ejects a liquid column (ink column) 107; charge electrodes 103A and 103B that individually electrically charge famed droplets (ink droplets) 106; a pair of deflection electrodes 105A and 105B for deflecting the electrically charged droplets 106 by an electric field; a gutter 113 that collects droplets 106B not used for printing to reuse the droplets 106B; and a cover portion (a printing head cover, a recording head cover) 118.

The deflection electrodes 105A and 105B are installed to have opposing surfaces parallel to each other. Printing is made by making particles of the droplets 106A land onto the printing body 116.

The cover portion 118 has a slit that is a passing hole through which printing droplets pass (ink droplet passing hole), and is one component of the recording head 100 to cover the printing mechanism (recording mechanism) configured by the ink chamber 101, the nozzle head 102, the charge electrodes 103A and 103B, the deflection electrodes 105A and 105B, the gutter 113, etc.

In the configuration illustrated in FIG. 1, the liquid column 107 ejected from the nozzle of the nozzle head 102 is cut by vibration applied from the upper portion of the ink chamber 101 in the nozzle head 102, and a train of the droplets 106 (droplet train) is formed as illustrated. Here, the entire body of the nozzle head 102 is electrically grounded. The formed droplets 106 are negatively charged by the charge electrodes 103A and 103B that are formed on charge electrode substrates 104A and 104B and that are arranged near to each other in parallel to the flight direction of the liquid droplets.

Here, the charge electrodes 103A and 103B are configured to charge each liquid droplet in response to an aimed printing form by inputting (applying) any voltage to the liquid droplets from a charging voltage controller 114 at any timing.

It is noted that, at this time, the cutting point of the liquid column 107 is positioned above the charge electrodes 103A and 103B provided corresponding to the droplet train. Moreover, it is preferable that the charge electrodes 103A and 103B are arranged to make the droplet train pass around the center in the width direction of the droplet train (the direction perpendicular to the paper of the drawing).

Here, the so-called deflection electrodes 105A and 105B that form a deflection electric field for deflecting the electrically charged droplets 106A in any direction are installed to the lower portion in the ink flight direction (below the charge electrodes 103A and 103B) in the charging process. These deflection electrodes 105A and 105B include a grounding deflection electrode (the first deflection electrode) 105A and a high voltage deflection electrode (the second deflection electrode) 105B. The grounding deflection electrode 105A and the high voltage deflection electrode 105B are arranged parallel to and opposite each other. The electric field lines are perpendicular to the electrode surfaces of the grounding deflection electrode 105A and high voltage deflection electrode 105B and generated in parallel to each other.

The size of the deflection electric field that occurs between the deflection electrodes 105A and 105B is controlled by controlling the magnitude of the voltage applied to the high voltage deflection electrode 105B by use of the deflecting voltage controller 115.

The droplets (including the electrically charged droplets 106A and the uncharged droplet 106B) after passing through the charge electrodes 103A and 103B fly in the region in which this deflection electric field is formed. Under the influence of the deflection electric field, the electrically charged droplets 106A are deflected toward the electrode 105B that is opposite the charge sign and land onto the printing body 116 to form a printing pattern.

The highly electrically charged droplets approach the positive electrode 105B. Therefore, an ink incident line 101' is set to a position nearer to the electrode surface of the grounding deflection electrode 105A than to the electrode surface of the high voltage deflection electrode 105B to print a large character.

Moreover, an airflow 108 is induced by the flight of the droplets (ink particles) 106 between the deflection voltages 105A and 105B. At this time, the uncharged particles 106B fly on the ink incident line 101' of this straight line and enter the gutter 113.

Figure 2:
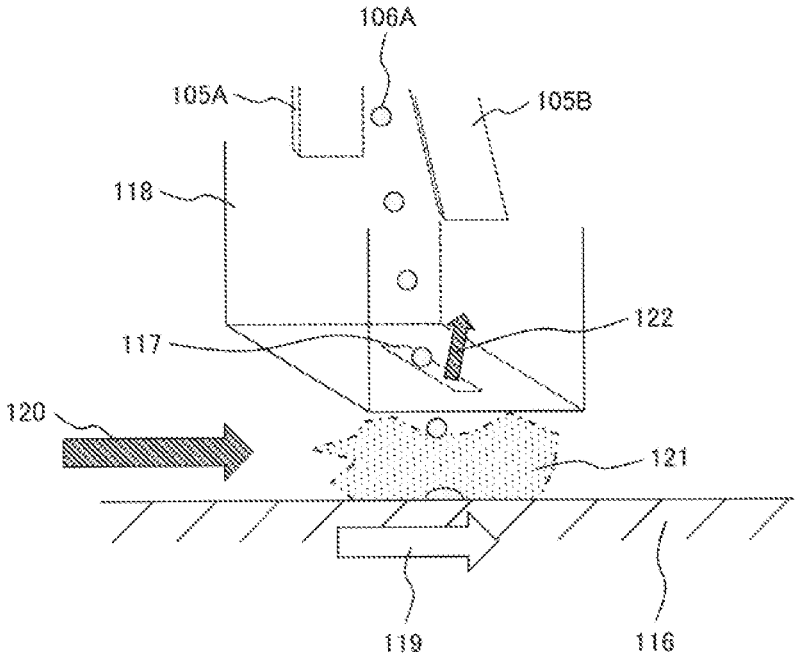
FIG. 2 illustrates a diagram to explain a problem in a conventional continuous inkjet printer.

A problem in a conventional continuous inkjet printer is explained using FIG. 2. FIG. 2 illustrates a diagram explaining the problem in the conventional continuous inkjet printer.

The printing droplets 106A are ejected from a slit 117 and land onto the printing body 116. Some of the droplets is splashed due to the impact at that case to generate suspension of micro droplets (ink mist) such as 121. It is noted that, when the printing droplets 106A are ejected from the slit 117, the printing droplets 106A come out of the cover portion 118 with entraining ambient air. The pressure inside the cover portion 118 thus decreases. To compensate for this decrease in pressure, an airflow 122 is generated to flow in from outside the cover portion 118 through the slit 117. When this airflow 122 is generated, the suspended micro droplets 121 is entrained in the airflow 122 to enter the interior of the cover portion 118. This causes the problem that the device inside the cover portion 118 (printing mechanism) is dirtied.

Figure 3:
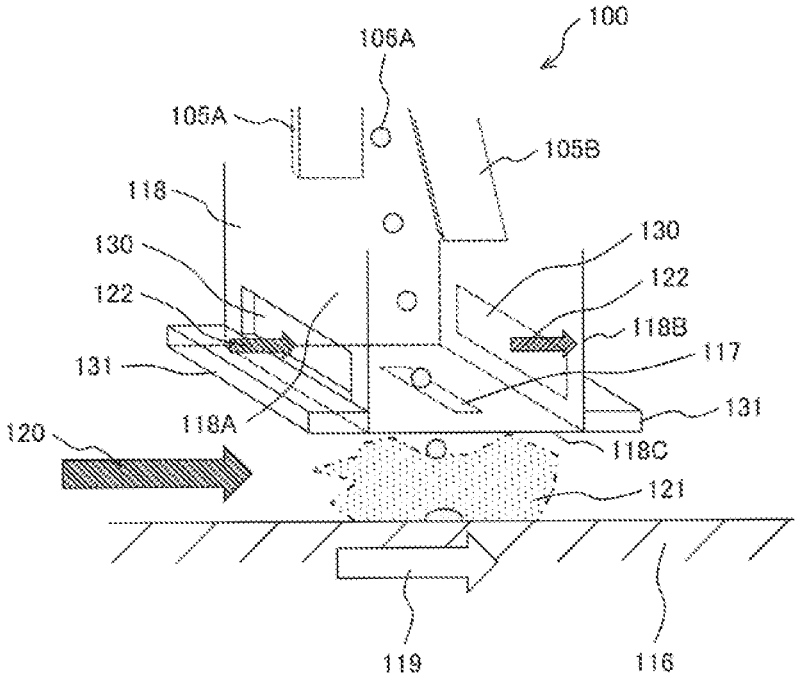
FIG. 3 illustrates a main configuration of the continuous inkjet printer of the first embodiment of the present invention.

A configuration of the continuous inkjet printer of the present embodiment is explained using FIG. 3. FIG. 3 illustrates a main configuration of the continuous inkjet printer of the first embodiment of the present invention.

A characteristic of the present embodiment shown in FIG. 1 is that a vent 130 having an opening surface perpendicular to a movement direction 119 of the printing body 116 is provided to the cover portion 118 of the printer 100. In FIG. 1, the opening surface of the vent 130 is provided to the parallel surface of the cover portion 118 to the paper of FIG. 1.

That is, in the present embodiment, the recording head 100 is provided including: the recording mechanism (printing mechanism) having the ink chamber 101 that ejects the ink column 107, the charge electrodes 103A and 103B that charge the ink droplets 106 generated from the ink column 107, and the deflection electrodes 105A and 105B that deflect the electrically charged ink droplets 106A; and the cover portion 118 that has the ink droplet passing hole 117 through which the ink droplets 106A deflected by the deflection electrodes 105A, 105B pass and that covers the recording mechanism. In the inkjet device that performs recording by making the ink droplets 106A land onto the recording object 116 moving relative to the recording head 100, the vent 130 is provided to the side surface of the cover 118.

In this case, it is preferable that the side surface of the cover portion 118 to provide the vent 130 is a surface 118A formed from the bottom surface 118C in the direction away from the recording object 116.

Further, it is preferable that the side surface 118A of the cover portion 118 to form the vent 130 is configured as a surface perpendicular to the relative movement direction (conveyance direction) 119 of the recording object 116. In this case, the vent 130 has an opening surface perpendicular to the relative movement direction 119 of the recording object 116.

When the printing body 116 moves, the airflow 120 is generated parallel to the movement of the printing body 116. In the present embodiment, by use of the airflow 120, it becomes possible to efficiently induce the airflow 122 into the interior of the cover portion 118 through the vent 130, and the airflow can be prevented or inhibited from flowing from the exterior to the interior of the cover portion 118 through the slit 117. As a result, it becomes possible to prevent or inhibit the micro droplets (ink mist) 121 from entering the interior of the cover portion 118 through the slit 117.

When it is possible to induce the airflow 122 into the interior of the cover portion 118 without using the airflow 120, the vent 130 may be provided to another surface of the cover portion 118, for example, to a parallel side surface to the movement direction 119 of the printing body 116.

The vents 130 are respectively formed to two perpendicular surfaces of the cover portion 118 to the conveyance direction 119 of the printing body 116.

That is, as the side surfaces to form the vents 130, the cover portion 118 has two side surfaces 118A and 118B located to opposite sides of the recording mechanism and ink droplet passing hole (slit) 117 in the relative movement direction 119 of the recording object 116. The vents 130 may be respectively provided to the two side surfaces 118A and 118B.

In the present embodiment, the cover portion 118 is formed to have a square cross section seen from a direction perpendicular to the printing surface of the printing body 116. The vents 130 are respectively formed to the side surfaces 118A and 118B forming two sides of this square. The airflow 122 induced into the cover portion 118 is mainly induced from the vent 130 located at the upstream side in the conveyance direction (upstream side in the relative movement direction) of the printing body 116. By providing the vents 130 to the two surfaces of the cover portion 118, the airflow 122 can be induced into the interior of the cover portion 118 by using the airflow 120 also when the conveyance direction of the printing body 116 is reversed.

Moreover, it is preferable that the airflow flowing from one (on the upstream side in the conveyance direction, upstream side in the relative movement direction) of the two vents 130 into the interior of the cover portion 118 flows out of the other (downstream side in the conveyance direction, downstream side in the relative movement direction) of the vents 130. The airflow 120 that flows from the upstream side in the conveyance direction toward the downstream side in the conveyance direction forces the micro droplets (ink mist) 121 to flow toward the downstream side in the conveyance direction. Thus, the micro droplets 121 is unlikely to flow from the vent 130 on the upstream side in the conveyance direction into the interior of the cover portion 118 and likely to flow from the vent 130 on the downstream side in the conveyance direction into the interior of the cover portion 118. The airflow 122 is configured to flow out of the vent 130 on the downstream side in the conveyance direction to the exterior of the cover portion 118. The micro droplets 121 can be thus prevented or inhibited from being drawn from the vent 130 on the downstream side in the conveyance direction.

It is noted that the vents 130 provided to the cover portion 118 are described as the opening portion in the embodiment but may also be meshed or have many holes. Moreover, it is preferable that the area of the vent 130 is that of the slit 117 or more to compensate for the air that flows out by being entrained by the printing droplets 106A. That is, it is preferable that the area of the vent 130 is the opening area of the slit (ink droplet passing hole) 117 or more.

Further, as shown in FIG. 3, the recording head 100 of the present embodiment has, at the entrance of the vent 130 (outside the opening portion), a fairing 131 projecting from the side surface of the cover portion 118 in parallel to the movement direction 119 of the printing body (recording object). The airflow that wraps under the cover portion is reduced using this fairing 131 to allow more airflow to flow to the vent 130. Further, with the fairing 131, it becomes possible to prevent or inhibit the micro droplets suspended below the cover portion 118 from entering the vent 130.

The fairing 131 is not an essential component, but the above advantageous effect is acquirable using the fairing 131.

Embodiment 2

Figure 4:
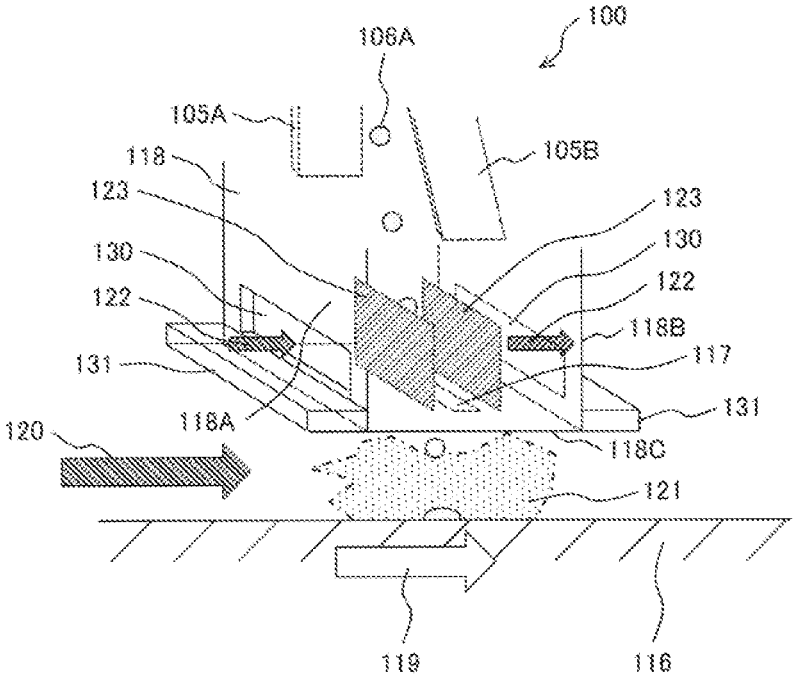
FIG. 4 illustrates a main configuration of a continuous inkjet printer of the second embodiment of the present invention.

A configuration of a continuous inkjet printer of the second embodiment is explained using FIG. 4. FIG. 4 illustrates a main configuration of the continuous inkjet printer of the second embodiment of the present invention.

As a characteristic in the present invention, in the configuration of the first embodiment shown in FIG. 3, a shield plate 123 is provided inside the cover portion 118 to prevent the airflow that flows in from the vent 130 from directly impinging on the printing droplets. It is possible to shield the airflow that flows in from the vent 130 by use of the shield plate 123. Therefore, an advantageous effect is acquired to prevent the airflow 122 from affecting the trajectory of the flying droplets 106A while preventing the pressure inside the cover portion 118 from decreasing.

It is noted that, in the present embodiment, in consideration of the case where the conveyance direction of the printing body 116 is reversed, the shield plate 123 is arranged on either side of the upstream side and downstream side in the conveyance direction relative to the trajectory of the flying droplets 106, that is, the slit 117.

The present embodiment has the same configuration as the first embodiment except for the configuration of the shield plate 123.

Embodiment 3

Figure 5:
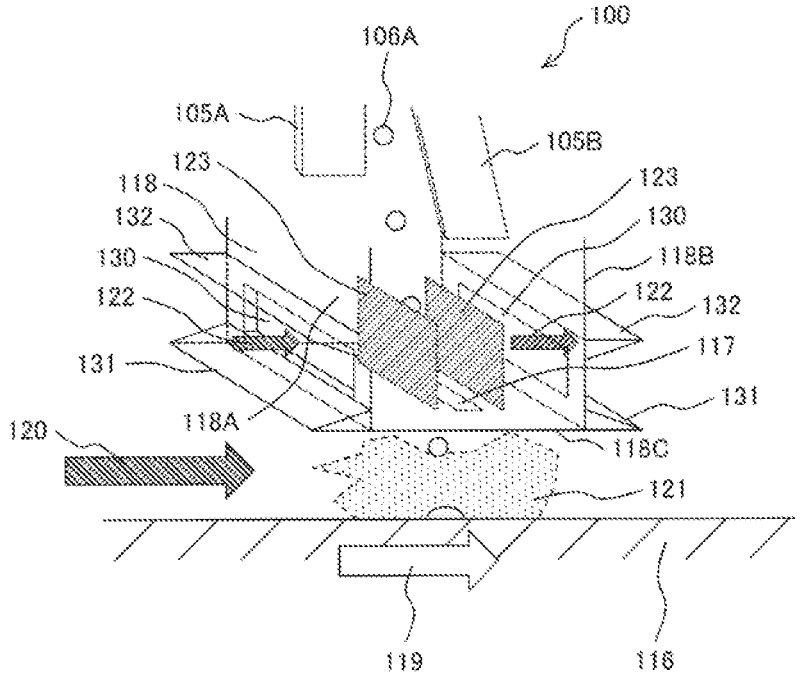
FIG. 5 illustrates a main configuration of a continuous inkjet printer of the third embodiment of the present invention.

A configuration of a continuous inkjet printer of the third embodiment is explained using FIG. 5. FIG. 5 illustrates a main configuration of the continuous inkjet printer of the third embodiment of the present invention.

As a characteristic in the present embodiment, the fairing 131 of the first embodiment is tapered. That is, the fairing 131 and a fairing 132 are arranged in a tapered shape to form a tapered passage for the airflow 122 at the entrance of the vent 130. It thus becomes possible to send the airflow to the vent 130 more efficiently.

Moreover, in the present embodiment as well as in the second embodiment, the shield plate 123 is arranged but may not be necessarily arranged.

Embodiment 4

Figure 6:
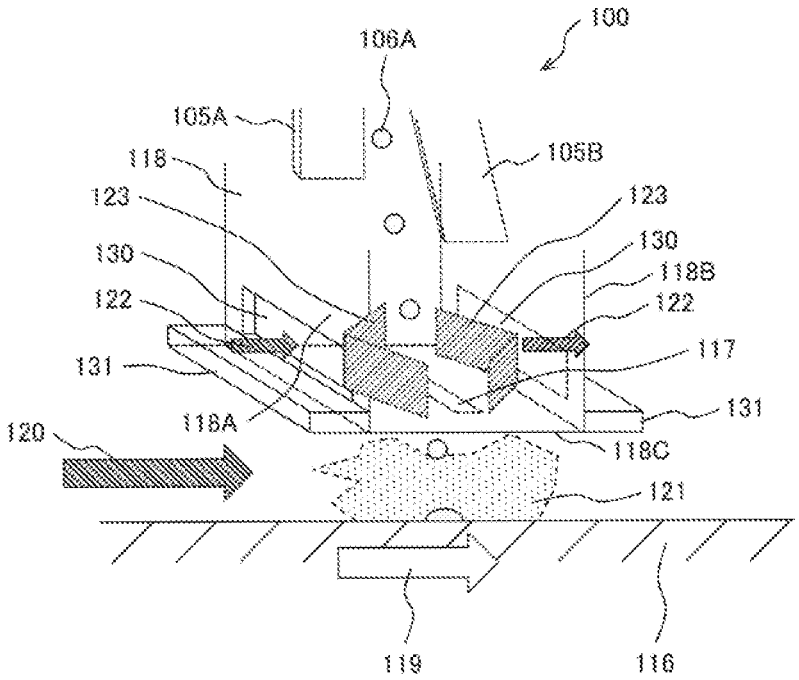
FIG. 6 illustrates a main configuration of a continuous inkjet printer of the fourth embodiment of the present invention.

A configuration of a continuous inkjet printer of the fourth embodiment is explained using FIG. 6. FIG. 6 illustrates a main configuration of the continuous inkjet printer of the fourth embodiment of the present invention.

The present embodiment is characterized by inclining the shield plate 123 shown in FIG. 4 relative to the direction of the airflow 122 that flows in from the vent 130. That is, the shield plate 123 is inclined relative to the direction of the airflow that flows in from the vent 130.

When the shield plate 123 is perpendicular to the airflow 122 that flows in from the vent 130 as shown in FIG. 4, pressure increases in front of the shield plate 123, and the airflow is unlikely to enter from the vent 130. Then, by inclining the shield plate 123 relative to the inflow direction of the airflow, the increase in pressure in front of the shield plate is reduced to allow more airflow to flow in.

Particularly in the present embodiment, the shape of the shield plate 123 seen from the direction perpendicular to the printing surface of the printing body 116 has a V shape whose opposite end portions are positioned downstream of the center portion. By inclining the shield plate 123 in the V shape, the size required for the arrangement in the inflow direction of the airflow is allowed to be small, and the inclining angle of the shield plate 123 to the inflow direction of the airflow is allowed to be large.

The shield plate 123 of the third embodiment shown in FIG. 5 as well as in the present embodiment may be inclined to the direction of the inflowing airflow 122.

LIST OF REFERENCE SIGNS

100 recording head
101 ink chamber
103A, 103B charge electrode
105A, 105B deflection electrode
106 ink droplet
106A electrically charged ink droplet
107 ink column
116 recording object (printing body)
117 ink droplet passing hole (slit)
118 cover portion
118A, 118B side surface of cover portion 118
118C bottom surface of cover portion 118
119 relative movement direction (conveyance direction) of recording object 116
123 shield plate
130 vent
131,132 fairing

The invention claimed is:

1. An inkjet printer comprising a recording head, the recording head including:

a recording mechanism having an ink chamber that ejects an ink column, a charge electrode that electrically charges ink droplets generated from the ink column, a deflection electrode that deflects the electrically charged ink droplets; and a cover portion that has an ink droplet passing hole through which the ink droplets deflected by the deflection electrode pass and covers the recording mechanism, the inkjet printer making the ink droplets land onto a recording object moving relative to the recording head to execute recording, wherein a vent is provided to a side surface of the cover portion; and a shield plate is provided inside the cover portion to prevent an airflow flowing in from the vent from directly impinging ink droplets.

2. The inkjet printer according to claim 1 wherein the side surface of the cover portion is a surface formed from a bottom surface opposing the recording object in a direction away from the recording object.

3. The inkjet printer according to claim 2 wherein the side surface of the cover portion is formed as a perpendicular surface to a relative movement direction of the recording object.

4. The inkjet printer according to claim 3 wherein the vent has a perpendicular opening surface to a relative movement direction of the recording object.

5. The inkjet printer according to claim 3 wherein the cover portion has, as the side surfaces, two side surfaces located to opposite sides of the recording mechanism in a relative movement direction of the recording object.

6. The inkjet printer according to claim 1 wherein a fairing projected from the side surface of the cover portion is provided to an entrance of the vent in parallel to a movement direction of the recording object.

7. The inkjet printer according to claim 6 wherein the fairing is arranged in a tapered shape at an entrance of the vent.

8. The inkjet printer according to claim 1 wherein the shield plate is inclined relative to a direction of an airflow flowing in from the vent.

9. The inkjet printer according to claim 1 wherein an area of the vent has a size equal to or more than an opening area of the ink droplet passing hole.

* * * * *